US007854038B2

(12) United States Patent
Zahuranec et al.

(10) Patent No.: US 7,854,038 B2
(45) **Date of Patent: *Dec. 21, 2010**

(54) VACUUM CLEANER WITH REMOVABLE HANDLE

(75) Inventors: Terry L. Zahuranec, North Olmsted, OH (US); David Scott Smith, Avon Lake, OH (US); Daniel L. Steele, Concord, OH (US); Diane L. Dodson, Sagamore Hills, OH (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/507,212

(22) Filed: Jul. 22, 2009

(65) Prior Publication Data

US 2009/0282643 A1 Nov. 19, 2009

Related U.S. Application Data

(63) Continuation of application No. 11/266,400, filed on Nov. 3, 2005, now Pat. No. 7,587,786.

(51) Int. Cl.
*A47L 9/10* (2006.01)

(52) U.S. Cl. ..... 15/334; 15/338; 15/339; 15/351; 15/410

(58) Field of Classification Search ..... 15/329, 15/331, 334, 338, 339, 351, 410; *A47L 9/10*
See application file for complete search history.

(56) References Cited

U.S. PATENT DOCUMENTS

| | | | | |
|---|---|---|---|---|
| 1,421,958 | A | 7/1922 | Kirby | |
| 4,851,019 | A | 7/1989 | Ahlf et al. | |
| 4,905,343 | A | 3/1990 | Jailor | |
| 5,335,740 | A | 8/1994 | Meyer et al. | |
| 5,766,283 | A | 6/1998 | Bumb et al. | |
| 5,983,444 | A | 11/1999 | Jacobs et al. | |
| 7,587,786 | B2 * | 9/2009 | Zahuranec et al. | 15/329 |
| 2004/0049879 | A1 | 3/2004 | Park et al. | |
| 2004/0261213 | A1 | 12/2004 | Park et al. | |
| 2006/0130268 | A1 | 6/2006 | Park | |

* cited by examiner

*Primary Examiner*—David A Redding
(74) *Attorney, Agent, or Firm*—Jones Day

(57) ABSTRACT

A cleaning apparatus includes a base. A bracket is attached to the base. Wheels are rotatably attached to the base for wheeling the base across a floor. A cleaning attachment is configured to be attached to the base and moved against the floor to clean the floor as the base is wheeled across the floor. The base is manually pushed by a handle to wheel the base across the floor. The handle is configured to be removably attached to the base by being hooked onto the bracket and then pivoted relative to the bracket into an installed position.

8 Claims, 11 Drawing Sheets

VACUUM CLEANER WITH REMOVABLE HANDLE

CROSS REFERENCE TO RELATED APPLICATION

This is a continuation of U.S. patent application Ser. No. 11/266,400, filed Nov. 3, 2005, now U.S. Pat. No. 7,587,786 hereby incorporated herein by reference.

TECHNICAL FIELD

This application relates to vacuum cleaners.

BACKGROUND

A vacuum cleaner includes a base and different cleaning attachments and handles that are removably attachable to the base. The cleaning attachments include a vacuuming head for vacuuming a carpet, a shampooing head for shampooing the carpet, and an accessory hose for cleaning above-the-floor household surfaces. The handles include an upright handle for pushing the base over the carpet and a portable handle for lifting the base to reach above-the-floor surfaces.

SUMMARY

A cleaning apparatus includes a base. A bracket is attached to the base. Wheels are rotatably attached to the base for wheeling the base across a floor. A cleaning attachment is configured to be attached to the base and moved against the floor to clean the floor as the base is wheeled across the floor. The base is manually pushed by a handle to wheel the base across the floor. The handle is configured to be removably attached to the base by being hooked onto the bracket and then pivoted relative to the bracket into an installed position.

Preferably, the handle, in its installed position, is fixedly attached to the bracket, and the bracket is pivotably attached to the base to enable the handle to pivot relative to the base. A dirt receptacle is attached to the handle and configured to be pivoted with the handle relative to the component. The base is configured to operatively sense whether the handle is attached to the base and control an operating condition of the apparatus based on whether the handle is attached. A differently-configured handle is configured to be removably attached to the base by being hooked onto the component and pivoted relative to the component into an installed position.

DESCRIPTION

Overview

Figure 1:
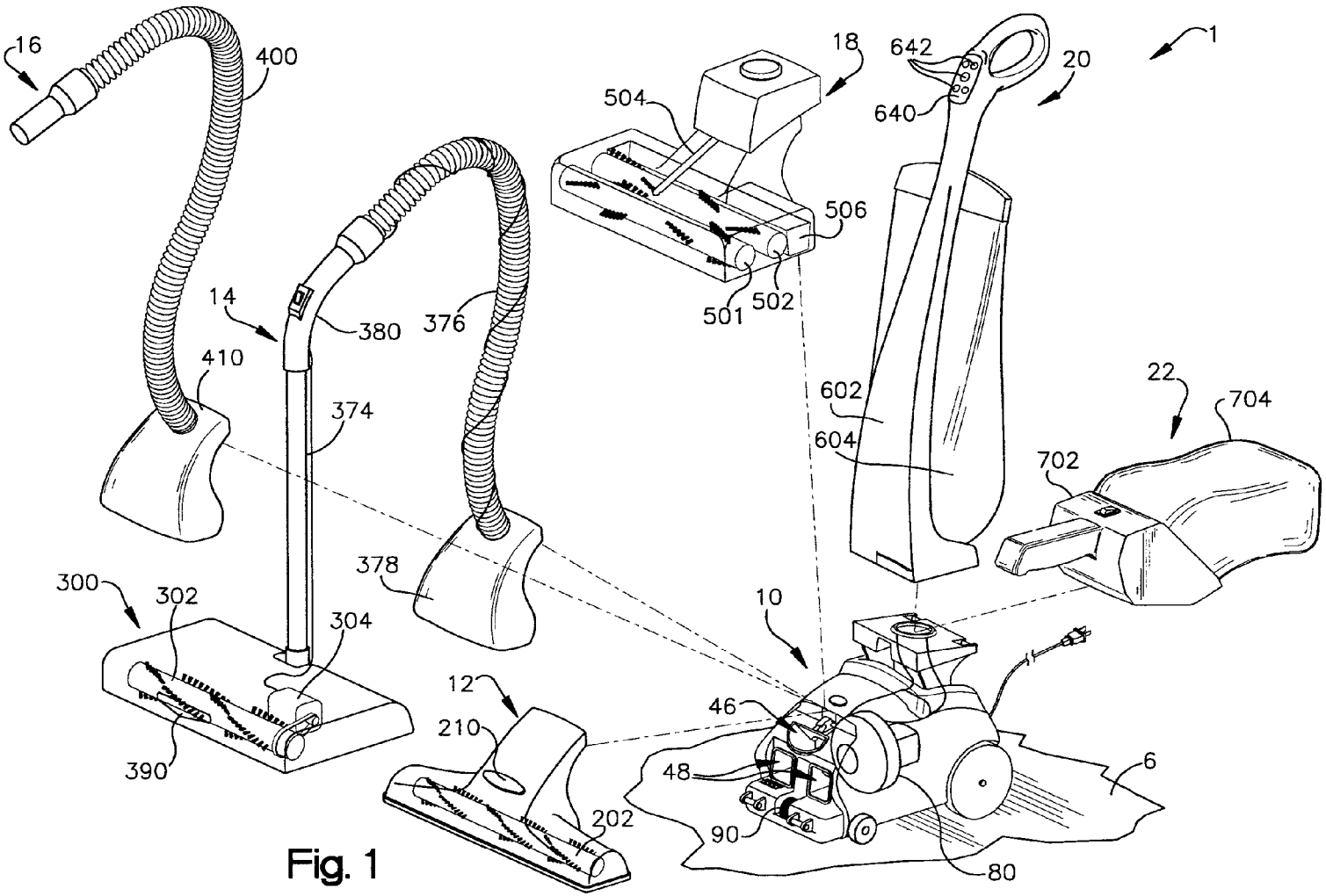
FIG. 1 is a perspective view of a vacuum cleaner base and different cleaning attachments and handle assemblies that can be removably attached to the base.

The apparatus 1 shown in FIG. 1 has parts that are examples of the elements recited in the claims. The apparatus thus includes examples of how a person of ordinary skill in the art can make and use the claimed invention. It is described here to meet the requirements of enablement and best mode without imposing limitations that are not recited in the claims.

The apparatus 1 is a cleaning system used for cleaning household surfaces, such as a carpeted floor 6. The system 1 includes a base 10 and different cleaning attachments and handle assemblies that can be removably attached to the base 10. The cleaning attachments include a vacuuming head 12, a power head assembly 14, an accessory hose 16 and a shampooing head 18. The handle assemblies include an upright handle assembly 20 and a portable handle assembly 22. Any of the attachments 12, 14, 16 and 18 can be installed on the base 10 with any of the handle assemblies 20 and 22.

Base

Figure 2:
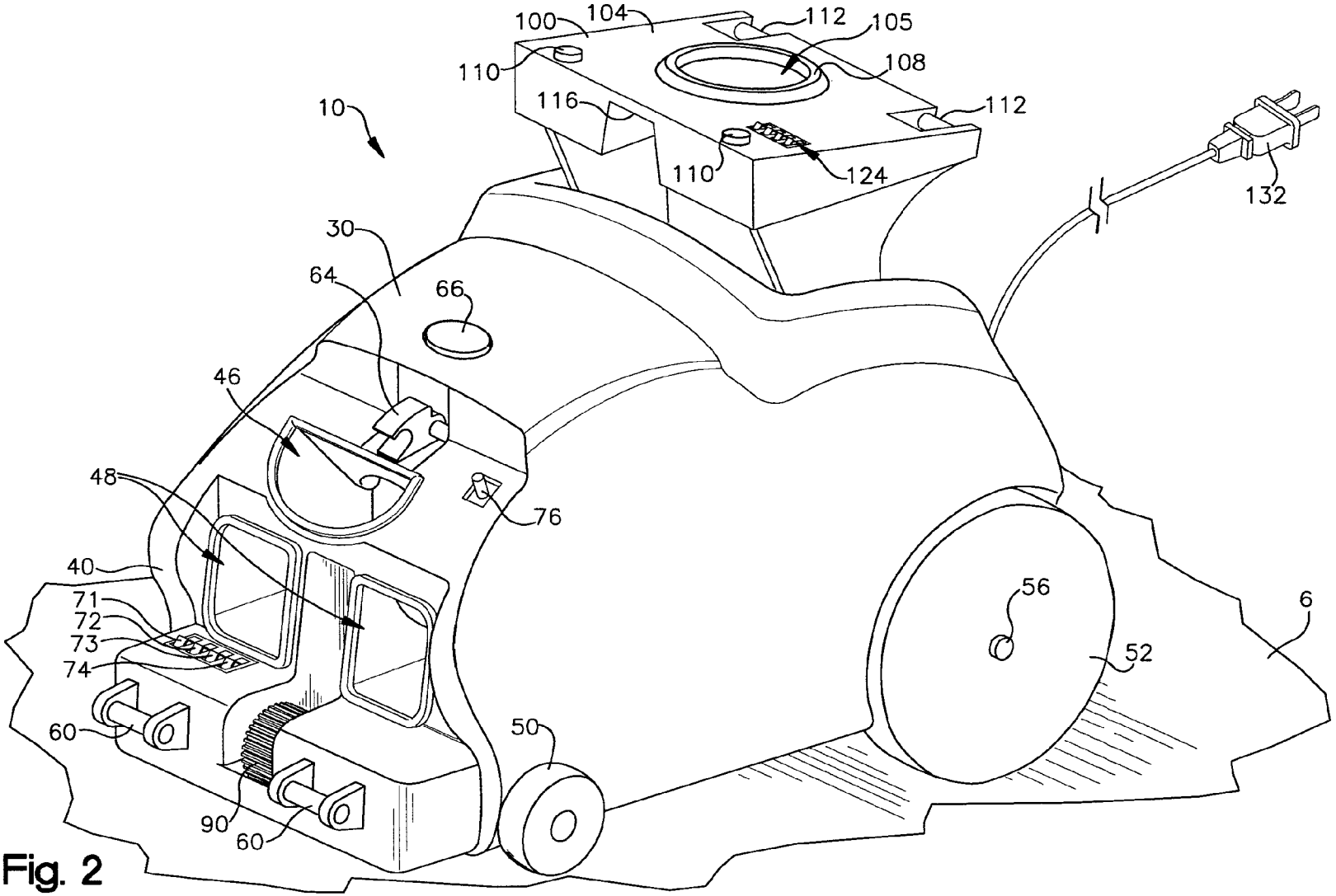
FIG. 2 is a perspective view of the base, showing its external parts.

As shown in FIG. 2, the base 10 has a housing 30 located on a horizontal longitudinal axis 31. The housing 30 has a front face 40 with upper and lower inlet ports 46 and 48. Two front wheels 50 and two rear wheels 52 are rotatable connected to the housing 30 for wheeling the base 10 over the floor 6. The rear wheels 52 are fixed to a common axle 56. The base 10 has two perch pins 60 and a bear claw latch 64 with a release button 66 for securing the cleaning attachments to the base 10. It also has four electrical contacts 71, 72, 73 and 74—respectively designated ground, 5 VDC-out, 24 VDC-out and resistance-sense. An attachment sensor 76 on the housing 30, in this example a pushbutton switch, senses whether the upper inlet port 46 is covered by a cleaning attachment.

Figure 3:
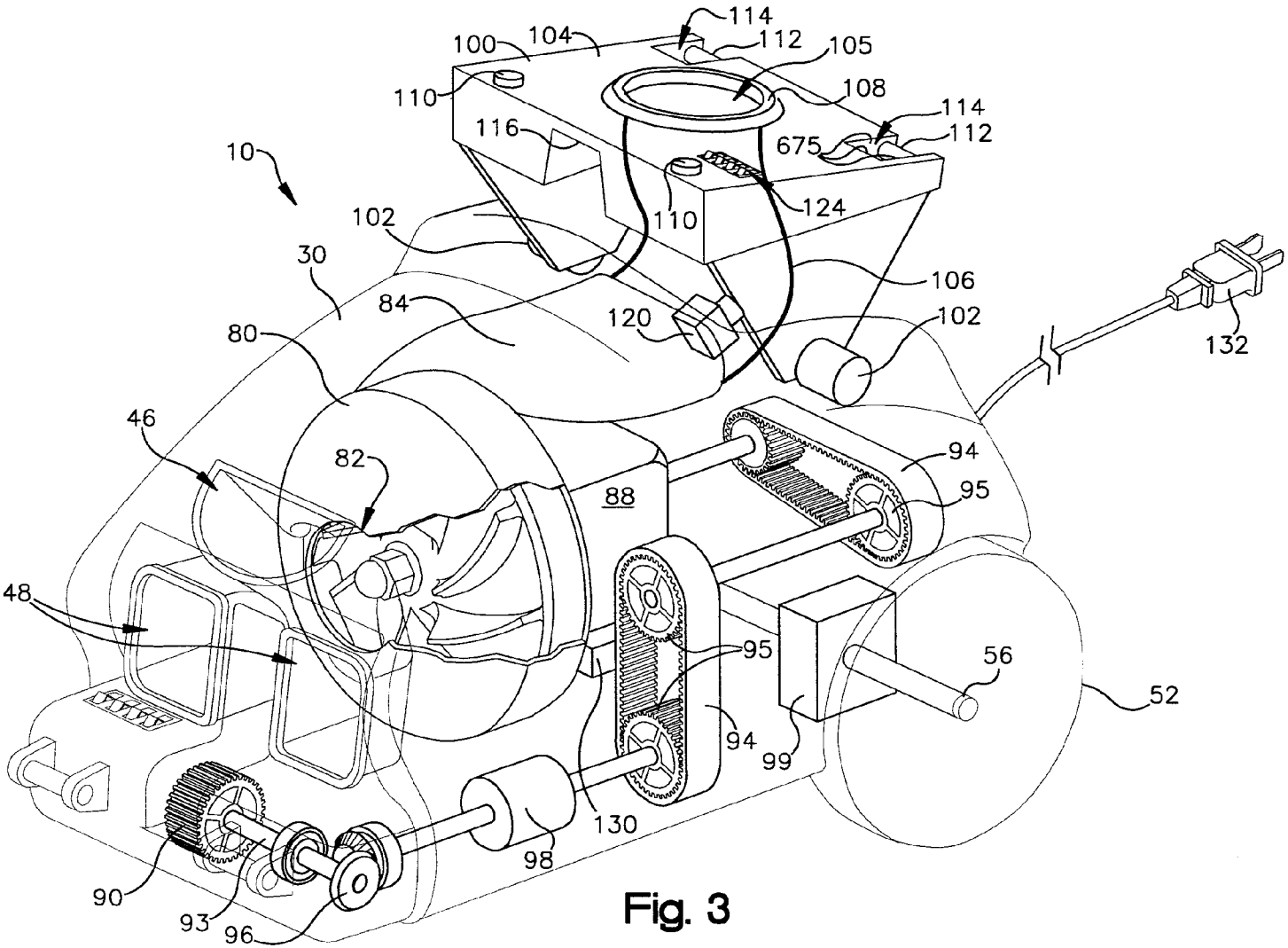
FIG. 3 is a perspective view of the base, showing its internal parts.

As shown in FIG. 3, the housing 30 encases a fan 80 that has an inlet 82 and an outlet 84 and is driven by a motor 88. The motor 88 also drives a drive pulley 90 through a drive train that includes shafts 93, belts 94, pulleys 95, a bevel gear 96 and an electrically actuated clutch 98. A drive assist motor 99 rotates the rear wheels 52 to propel the base 10.

A handle mounting bracket 100 is pivotally attached to the housing 30 by two prongs 102. The bracket 100 has a flat top surface 104 with an outlet port 105. The port 105 is connected to the fan outlet 84 by a flexible tube 106 that extends downward from a gasket 108 surrounding the port 105. Two spacers 110 at the top surface 104 prevent over-compression of the gasket 108. The bracket 100 has two pins 112 in respective notches 114 and a wedge surface 116, for securing the handle assemblies to the bracket 100.

An electronic position sensor 120 senses whether the bracket 100, and thus the upright handle assembly 20, is in an upright or inclined position. In this example, the sensor is a contact switch that is attached to the base 10 and contacts the bracket 100 when the bracket 100 is upright. A multi-contact electrical base terminal 124 is located at the top surface 104 of the handle bracket 100.

A controller circuit 130 is electrically connected to the electrical components 71-74, 76, 88, 98, 99, 120 and 124 (FIGS. 2 and 3) of the base 10 to monitor and control operation of the base 10. The circuit 130 receives wall current through a power cord 132. It generates a 5 VDC and 24 VDC supply that is output through the 5 VDC-out and 24 VDC-out contacts 72 and 73. It senses electrical resistance applied across the sense contact 73 and ground contact 71 by whichever attachment is installed on the base 10. Since each attachment applies a unique resistance, the controller 130 can determine which attachment, if any, is installed.

Cleaning Attachments

The four cleaning attachments 12, 14, 16 and 18 are shown in FIG. 1. They are described individually as follows.

The vacuuming head 12 has a brushroll 202. When the head 12 is attached to the base 10, the brushroll 202 is driven by the drive pulley 90 of the base 10 to rotate against the floor 6 to dislodge dirt from the floor 6. The fan 80 generates an air flow that draws the dirt from the floor 6 through the head 12. A headlight 210 is powered by electricity supplied by the base 10 through the ground and 5 VDC-out contacts 71 and 72 (FIG. 2).

The power head assembly 14 has a power head 300 with a brushroll 302 driven by a motor 304. The assembly 14 further has a tube structure comprising a rigid tube 374, a flexible tube 376 and a connector 378. The connector 378 can be removably attached to the base 10. In operation, the user grasps the rigid tube 374 by its handgrip 380 to push and pull the power head 300 over the floor 6. The flexible tube 376 enables the power head 300 to move independently of the base 10. The brushroll 302 rotates against the floor 6 to dislodge dirt. The fan 80 generates an air flow that carries the dirt from the floor 6, through the power head 300 and the tubes 374 and 376 into the upper inlet port 46 of the base 10. A headlamp 390 on the power head 300 illuminates the floor 6 in front of the power head 300. The headlamp 390 and the motor 304 are respectively powered by 5 VDC and 24 VDC supplied by the base 10 through the electrical contacts 71-73 (FIG. 2).

The accessory hose 16 includes a flexible tube 400 extending from a connector 410 that is attachable to the base 10. In operation, the fan 80 draws air through the flexible tube 400 and the upper inlet port 46 of the base 10.

The shampooing head 18 has front and rear brushrolls 501 and 502, both driven by the drive pulley 90 of the base 10. Shampoo is deposited onto the carpet 6 by a shampoo-dispensing device 504 of the head 18 and brushed into the carpet 6 by the brushrolls 501 and 502 to entrain dirt from the carpet 6. The shampoo is lifted from the carpet 6 by the rear brushroll 502 and collected in a take-up tray 506 in the head 18. The head 18 blocks air from entering the inlet ports 46 and 48.

Upright Handle Assembly

Figure 4:
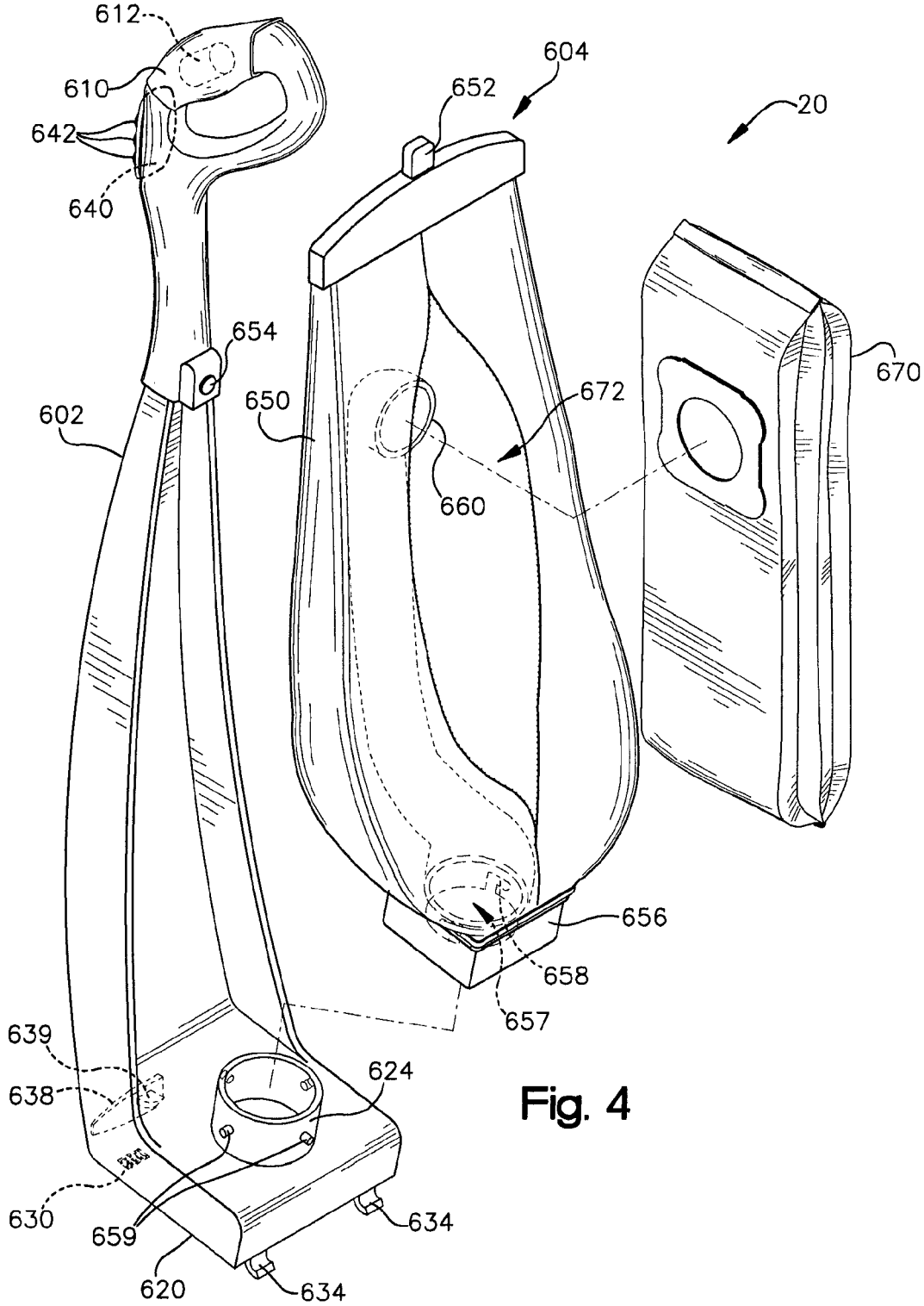
FIGS. 4 and 5 are exploded views of an upright handle assembly shown in FIG. 1, taken from two different viewpoints.
Figure 5:
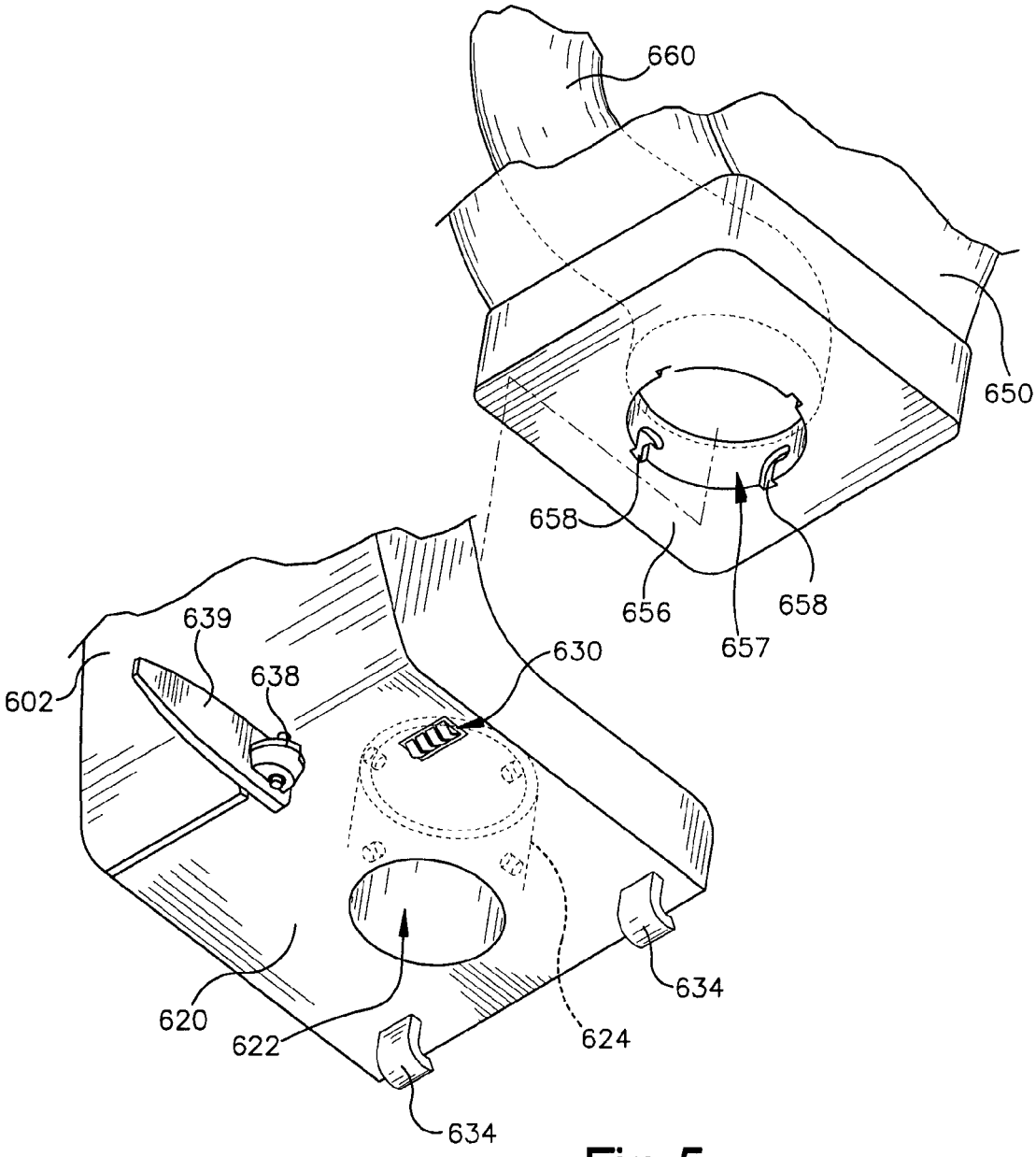

The upright handle assembly 20 shown in FIGS. 4-5 includes an upright handle 602 and a dirt receptacle 604. It enables the base 10 and the vacuuming head 12 to be used together as an upright vacuum cleaner. This type of cleaner is configured for the user to stand upright while manually pushing the cleaner by its handle 602 over the floor 6 to clean the floor 6.

The handle 602 has a handgrip 610 configured to be grasped by a user. A force sensor 612 in the handgrip 602 senses the direction and magnitude of the force applied by the user to push and pull the cleaner. The handle 602 further has a flat bottom 620 with an inlet port 622. An exhaust tube 624 extends upward from the inlet port 622. At the handle bottom 620, a multi-contact electrical terminal 630 mates with the terminal 124 on the base 10 to enable the controller 130 to communicate with electrical components of the handle 602. Two hooks 634 and a lever 638 with a wedge 639 are for attaching the handle 602 to the base 10.

The handle 602 has a user interface panel 640. The panel 640 has user interfaces 642 comprising controls and displays with which the user communicates with the controller 130. The controls are for manually selecting operating conditions of the cleaner. They include membrane switches for powering the fan motor 88 (FIG. 3), selecting motor speed, engaging the clutch 98, and activating the drive-assist motor 99. In contrast, the displays are for displaying operating conditions of the cleaner. They include lights for indicating fan motor speed, whether the brushroll is rotating, whether the drive-assist feature 99 is activated, and whether the dirt receptacle 602 is full. The base 10 is free of any operating controls and displays, because they are all on the handle 602. The panel 640 also outputs a signal to the controller 130 indicating what type of handle it is—in this case identifying itself as an upright handle. The panel 640 is sufficiently close to the handgrip 610 to enable a finger of a user's hand to press the controls while the hand is grasping the handgrip 610.

The dirt receptacle 604 includes a permanent outer filter bag 650. The bag 650 is suspended from a mounting tab 652 that snaps into a clip 654 on the handle 602. A rigid connector 656 at the bottom of the bag 650 has a hole 657 configured to receive the handle's exhaust tube 624. Bayonet slots 658 around the hole 657 receive bayonet lugs 659 on the exhaust tube 624. A fill tube 660 extends upward from the inlet port 657 into the outer bag 650. A disposable inner filter bag 670 is inserted into the outer bag 650 through a zippered opening 672 and press-fitted over the fill tube 660.

Figure 6:
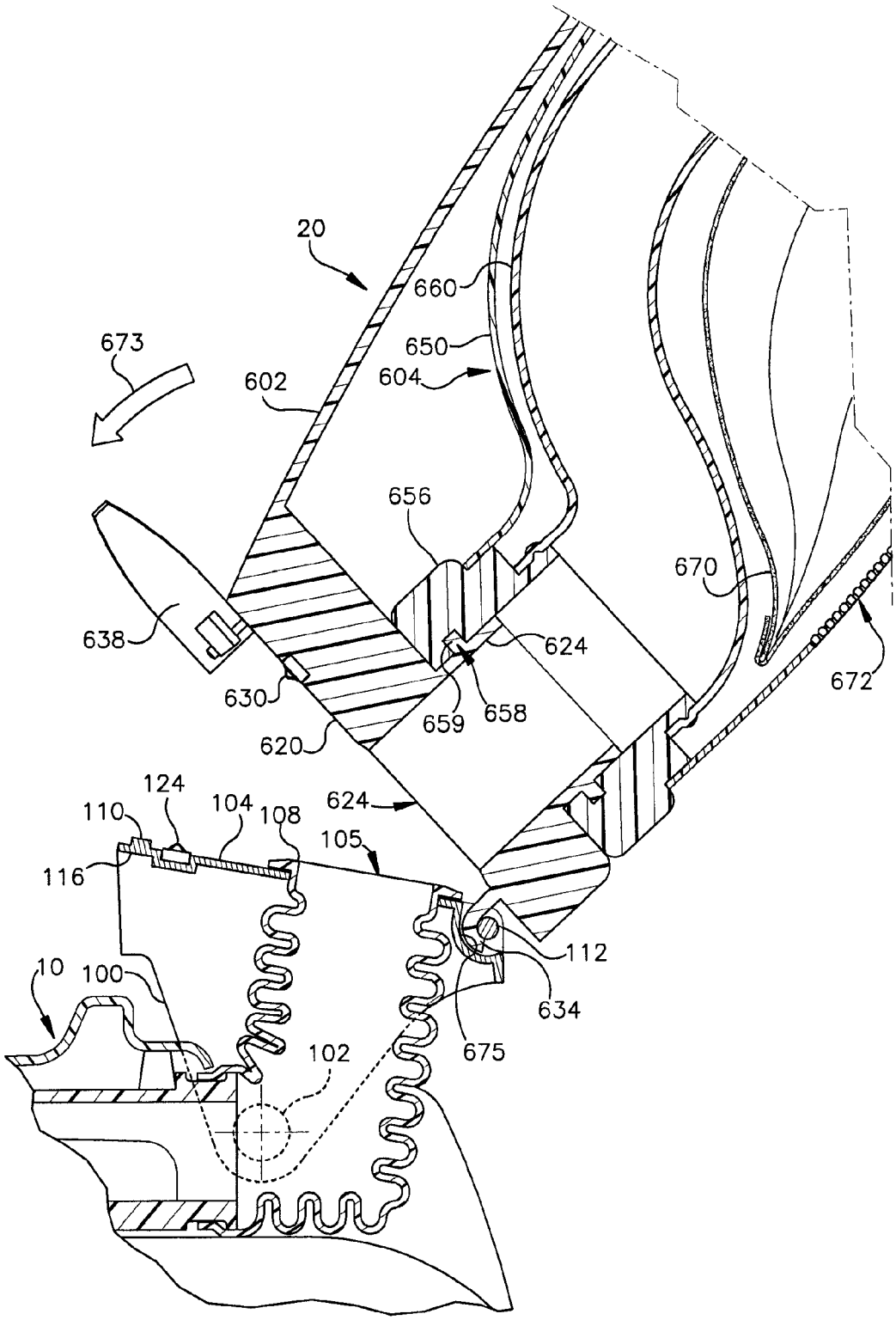
FIG. 6 is a sectional view illustrating a procedure for attaching the upright handle assembly to the base.

The handle 602 can be attached to the base 10 as shown in FIG. 6. First, the hooks 634 of the handle 602 are hooked onto the pins 112 of the base bracket 100. Next, the handle 602 is pivoted (arrow 673) forward and downward into its installed position shown in FIG. 7. Then, the lever 638 is pivoted (arrow 674) and wedged under the wedge surface 116 to lock the handle 602 in place.

In the installation procedure illustrated in FIG. 6, the pivoting movement (arrow 673) of the handle 602 toward and into its installed position moves its bottom surface 620 toward and into sealing engagement with the gasket 108 and also toward and into engagement with the spacers 100, and also moves the handle terminal 630 toward and into engagement with the base terminal 124. As the handle 602 pivots forward (arrow 673), proper alignment of the handle's inlet port 624 with the base's outlet port 105 is ensured by each hook 634 being closely captured by and between the respective pin 112 and walls 675 (FIG. 3) of the respective notch 114.

The sequence of steps of 1) installing the inner bag 670 in the outer bag 650, 2) installing the outer bag 650 on the handle 602, and 3) installing the handle 602 on the base 10 can be performed in any order.

Figure 7:
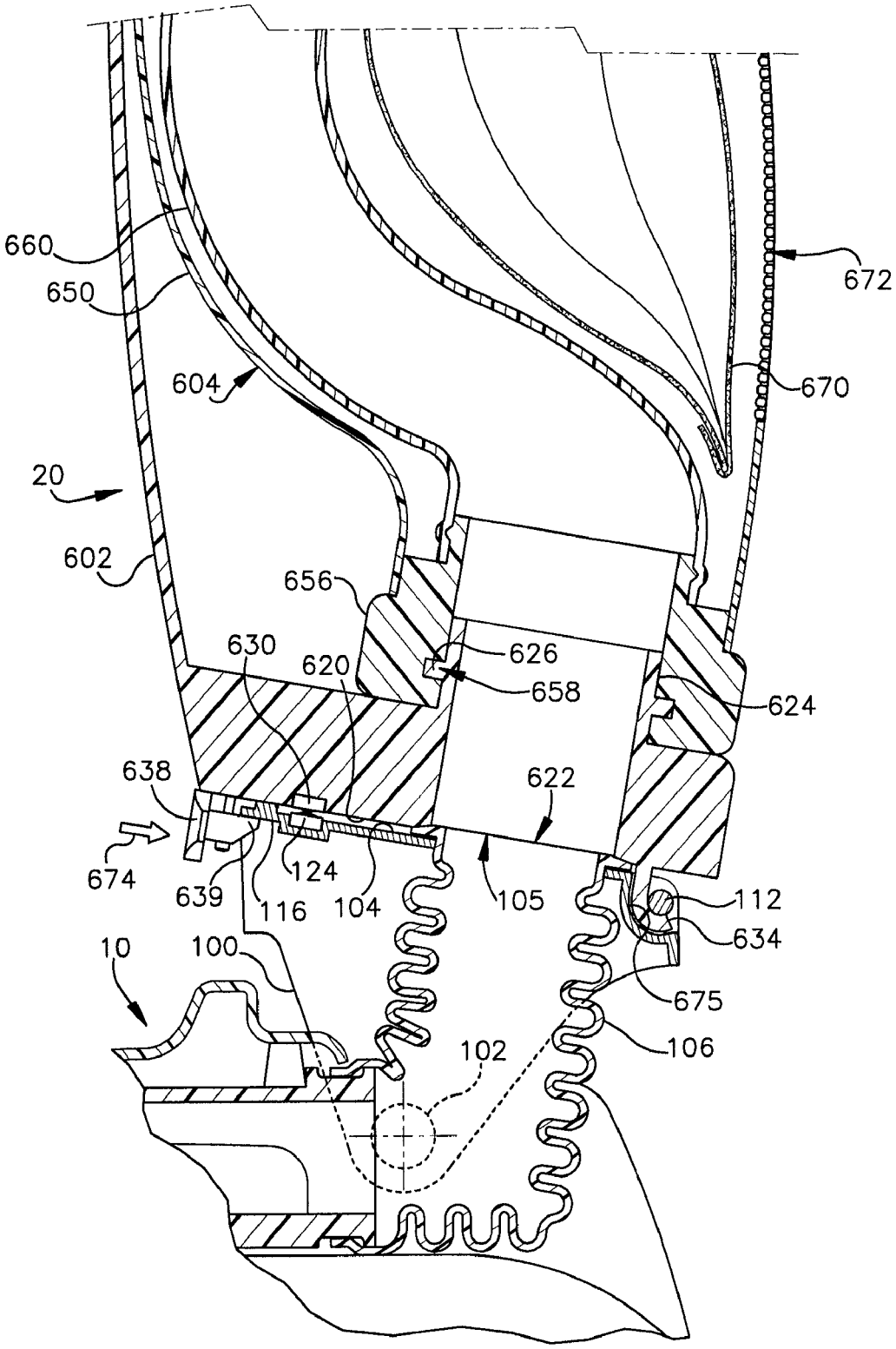
FIG. 7 is a sectional view showing the upright handle assembly attached to the base to form an upright vacuum cleaner.

The handle 602 in FIG. 7 can be removed from the base 10 by first pivoting the lever 638 out of engagement with the wedge surface 116 and then pivoting the handle 602 rearward about the pivot pins 112. The hooks 634 can then removed from the pivot pins.

Figure 8:
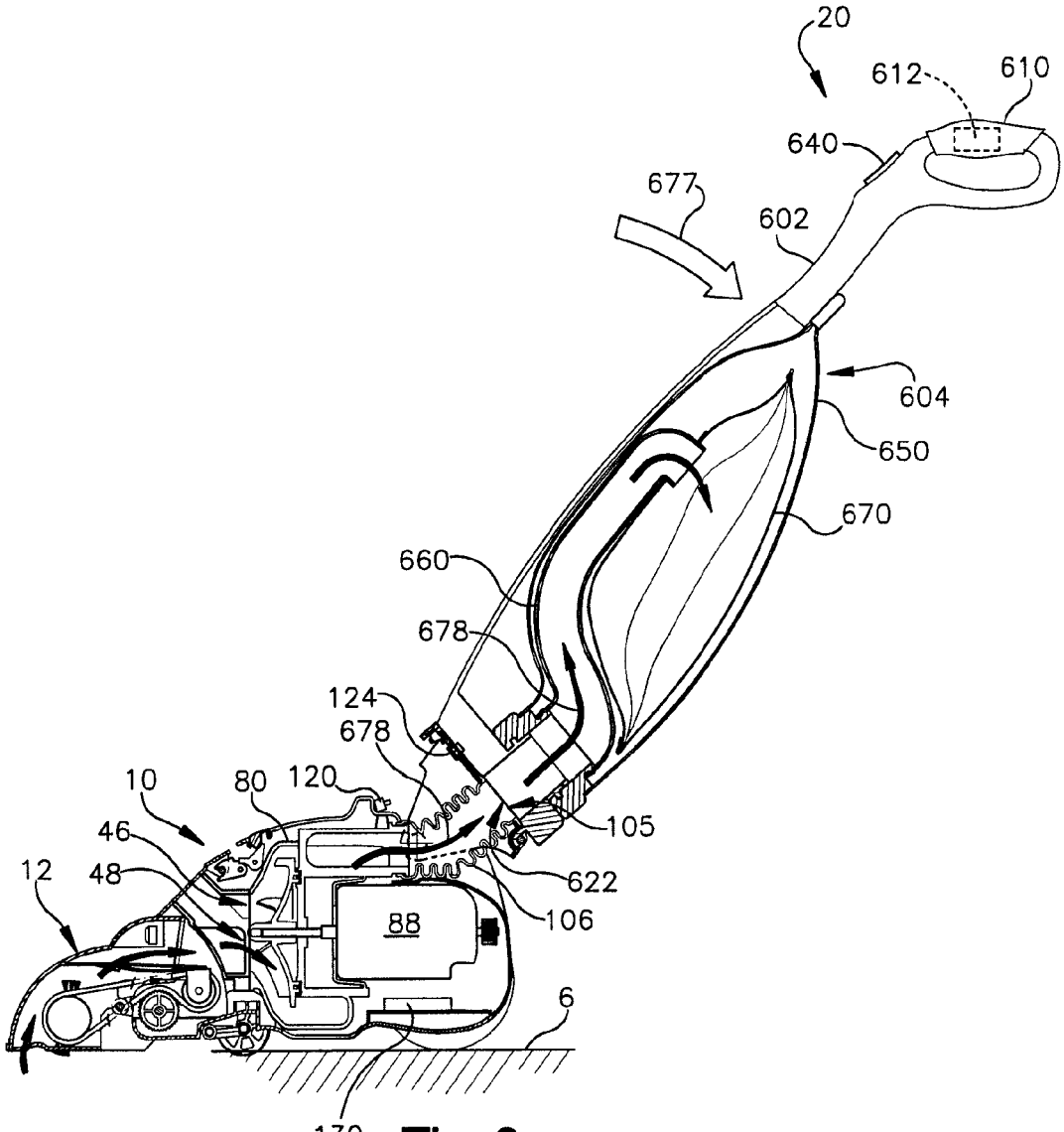
FIG. 8 is a sectional view illustrating operation of the upright vacuum cleaner.

As shown in FIG. 8, a user can grasp the handgrip 610 to pivot (arrow 677) the handle 602 rearward and push/pull the base 10 over the floor 6. When the user presses the power switch of the control panel 640, the controller 130 powers the motor 88 to drive the fan 80. The fan 80 generates an air flow (arrows 678) that carries dirt from the floor 6 through the vacuuming head 12, the lower inlet ports 48, the fan 80, the outlet port 105 and the fill tube 660 into the inner bag 670.

The controller 130 inputs operating parameters of the cleaner from various sensors and switches of the cleaner. Specifically, from the force sensor 612 in the handgrip 610, the controller 130 inputs the direction and magnitude of force manually applied to the handle 602. From the position sensor 120 in the base 10, the controller 130 determines whether the handle 602 is in the upright or inclined position. Through the control panel 640, the controller 130 determines which switch the user presses and the type of handle installed, and displays information to the user. No signal being received through the base terminal 124 indicates that no handle 602 is installed. From the attachment sense switch 76 (FIG. 2), the controller 130 determines whether the upper inlet port 46 is covered by a cleaning attachment. By sensing the electrical resistance across the ground and resistance-sense contacts 71 and 74, the controller 130 determines if a cleaning attachment, and which cleaning attachment, is installed.

The controller 130 controls operation of the cleaner based on the parameters input from the sensors and switches. For example, the controller 130 applies a higher default motor speed when the accessory hose 16 (FIG. 1) is attached than when the vacuuming head 12 is attached. The controller 130 engages the clutch 98 (FIG. 3), and thus engages the motor 88 to the drive pulley 90, only when, concurrently, a handle is installed and either the vacuuming hear 12 or shampooing head 18 is installed. The controller 130 will not power the motor 88 if no handle is installed or no cleaning attachment is installed. The controller 130 powers the drive assist motor 99 (FIG. 3) to rotate the rear wheels 52 in a direction and at a speed that correspond respectively to the direction and magnitude of the force manually applied to the handle 602. The drive assist motor 99 thus assists the user in propelling the base 10 over the floor 6. The controller 130 activates the drive-assist motor 99 (FIG. 3) only when, concurrently, either the vacuuming or shampooing head 12 or 18 is installed, the upright handle 602 is installed and inclined, and a "drive-assist" switch on the control panel 640 has been pressed.

Figure 9:
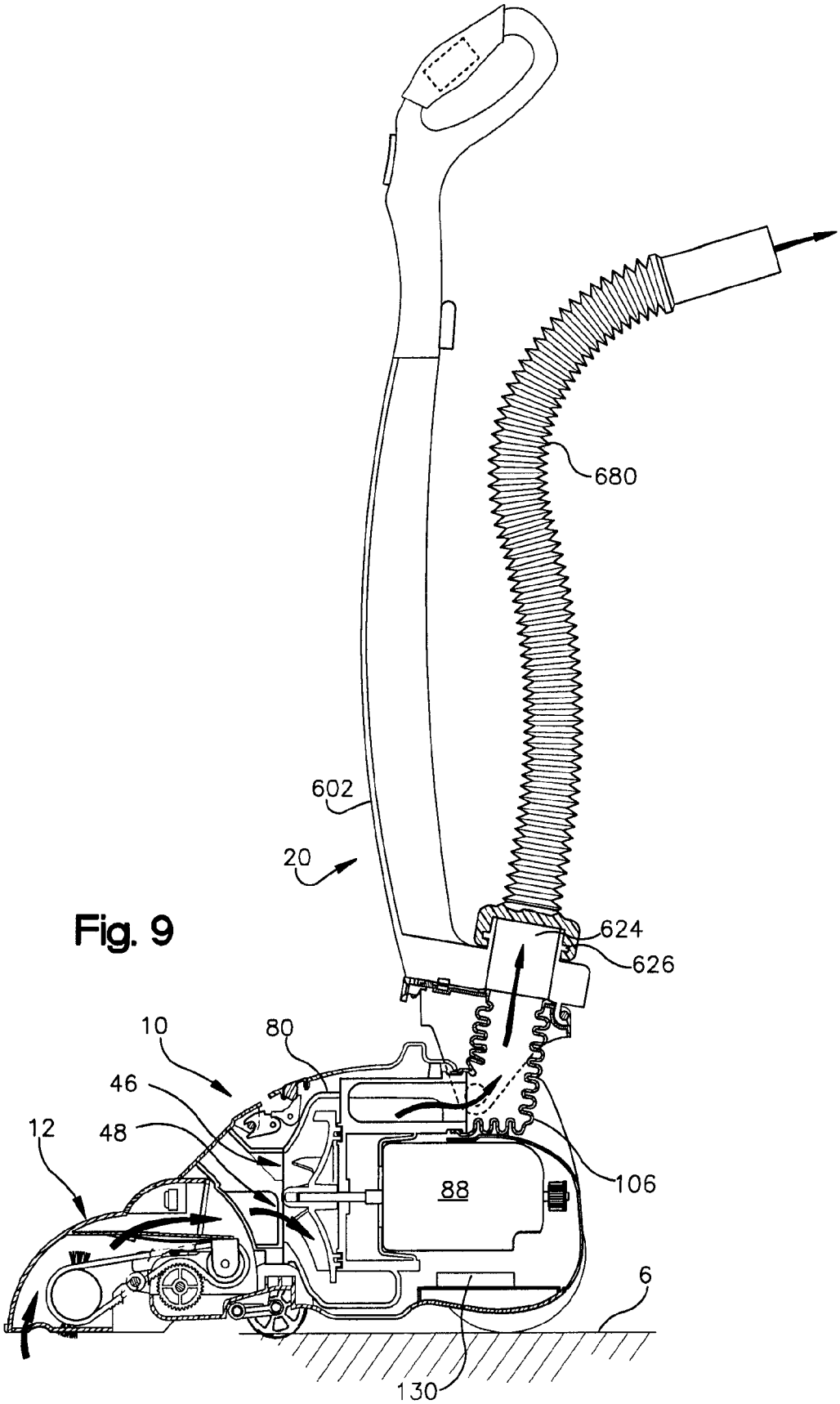
FIG. 9 is a sectional view showing a blower hose attached to the upright handle assembly.

As shown in FIG. 9, in place of the dirt receptacle 604 (FIG. 8), a blower hose 680 can be friction-fitted over the exhaust tube 624 of the handle 602 for use in blowing debris or inflating things.

Portable Handle Assembly

A portable handle assembly 22 shown in FIG. 1 includes a portable handle 702 and a dirt receptacle 704. It enables the base 10 and the vacuuming head to be used together as a portable vacuum cleaner. This type of cleaner is configured for the user to manually lift and move the cleaner by the handle 702 to clean vertical or above-the-floor household surfaces.

Figure 10:
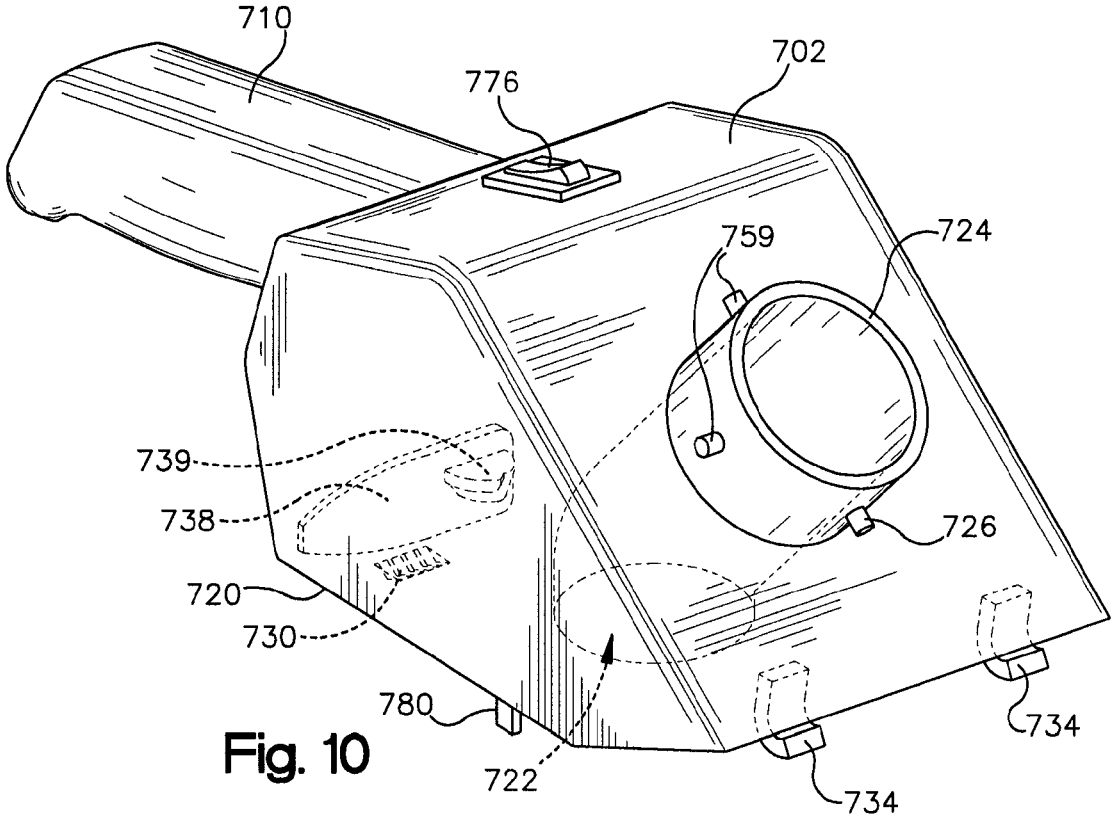
FIG. 10 is a perspective view of parts of a handle portion of a portable handle assembly shown in FIG. 1.

As shown in FIG. 10, the portable handle 702 has several parts that have the same functions as corresponding parts of the upright handle 602. These include a handgrip 710, a flat bottom 720 with an inlet port 722, an exhaust tube 724 extending upward from the port 722, an electrical terminal 730, two hooks 734, and a locking lever 738 with a wedge 739.

Figure 11:
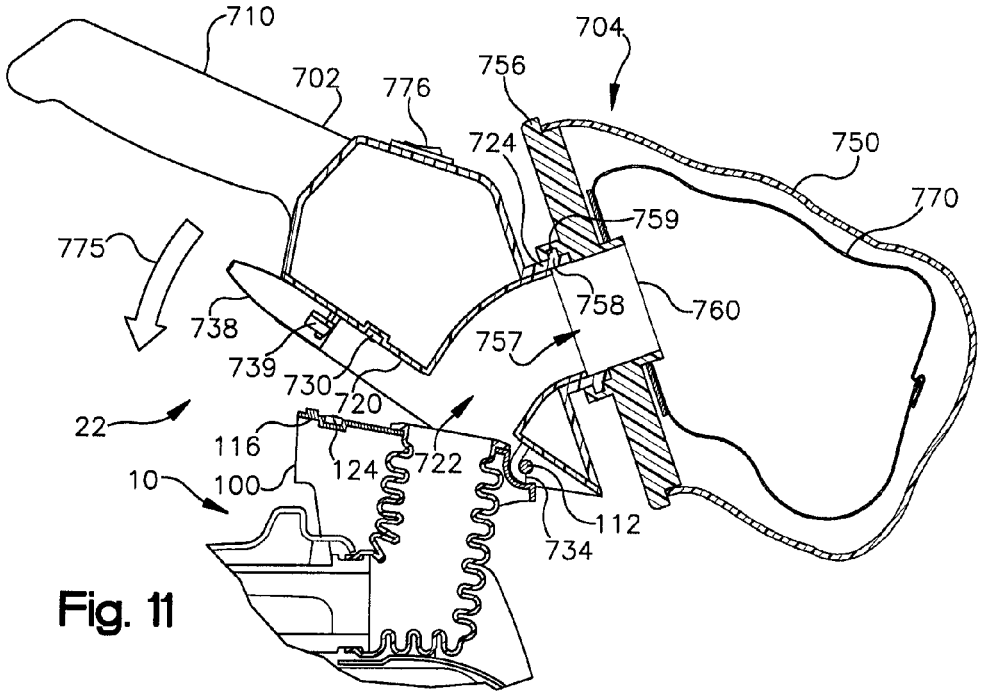
FIG. 11 is a sectional view illustrating a procedure for attaching the portable handle assembly to the base.

As shown in FIG. 11, the dirt receptacle 704 has a permanent outer filter bag 750. A rigid connector 756 at the bottom of the bag 750 is similar to the connector 656 of the upright handle assembly 20. The connector 756 has an inlet port 757 and bayonet slots 758 secured to bayonet lugs 759 of the handle's exhaust tube 724. A fill tube 760 extends from the inlet port 757 into the outer bag 750. A disposable inner filter bag 770 is inserted into the outer bag 750 through a zippered opening in the outer bag 750 and press-fitted over the fill tube 760.

The portable handle 702 can be installed in a manner similar to that of the upright handle 602. First, as shown in FIG. 11, the hooks 734 are hooked onto the pins 112 (FIG. 3) of the base bracket 100. Then, the handle 702 is pivoted (arrow 775) into the installed position shown in FIG. 12, and the lever 638 is pivoted to wedge the wedge 739 against the wedge surface 116 of the bracket 100.

The sequence of steps of 1) installing the inner bag 770 in the outer bag 750, 2) installing the outer bag 750 on the handle 702, and 3) installing the handle 702 on the base 10 can be performed in any order. In place of the bag assembly 704, the blower hose 680 (FIG. 9) can be friction-fitted over the exhaust tube 724 of the handle 702 for use in blowing debris or inflating things.

Figure 12:
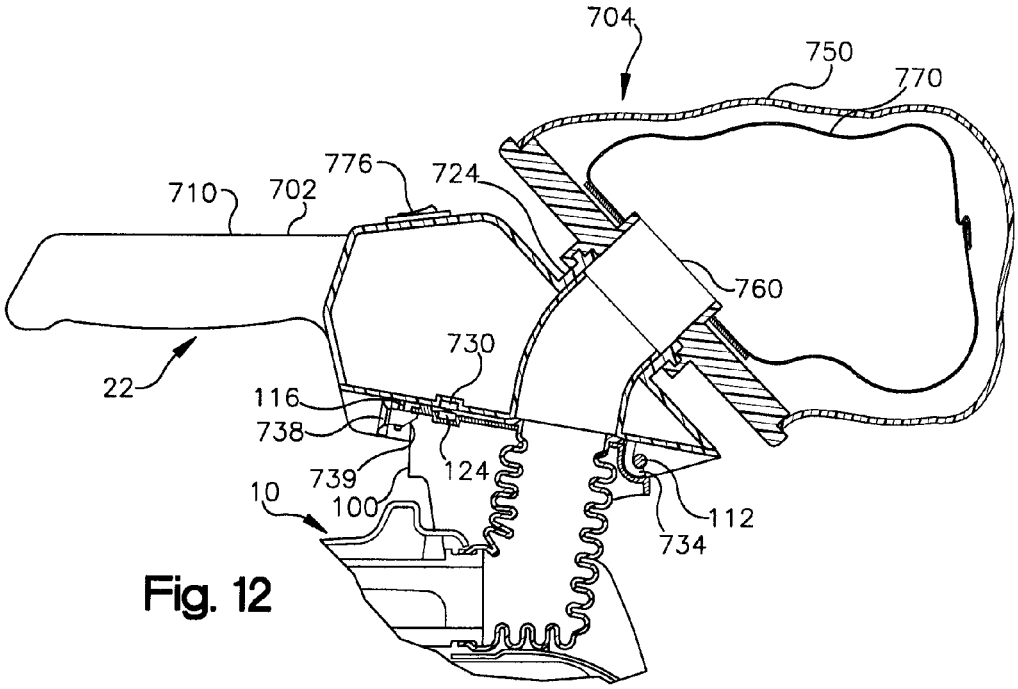
FIG. 12 is a sectional view showing the portable handle assembly attached to the base.

The portable handle 702 is different than the upright handle 602 in several ways. As shown in FIG. 12, the portable handle 702 projects forward over the base 10 instead of rearward away from the base 10. This is to orient its handgrip 710 directly above the center of gravity of the cleaner. In place of the upright handle's control panel 640 (FIG. 4), the portable handle 702 has a single rocker-type power switch 776 for powering the fan motor 88, and no displays. Unlike the upright handle 602, the portable handle 702 lacks a switch for activating the drive-assist, lacks a display for indicating whether the drive-assist is activated, and lacks the force sensor used for the drive-assist feature. Also unlike the upright handle 602, the portable handle 702 has a pivot-preventing projection 780 (FIG. 10) configured to be closely received in a groove (not shown) in the base 10 to prevent the handle 702 from pivoting.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. A cleaning apparatus comprising:

a base;

a bracket attached to the base;

wheels rotatably attached to the base for wheeling the base across a floor;

a cleaning attachment configured to be attached to the base and moved against the floor to clean the floor as the base is wheeled across the floor;

a handle for manually pushing the base by the handle to wheel the base across the floor, and configured to be removably attached to the base by a procedure that includes hooking the handle onto the bracket and then pivoting the handle relative to the bracket into an installed position;

a dirt receptacle attached to the handle and configured to be pivoted with the handle relative to the base; and an outlet port through which the base exhausts dirt laden air, and an inlet port through which the dirt-laden air enters the dirt receptacle, the outlet port being fixed to the bracket and the inlet port being fixed to the handle, such that the inlet port is moved toward and into connection with the outlet port by pivotal movement of the handle toward and into its installed position.

2. The apparatus of claim 1 wherein the base is a vacuum cleaner base that includes a fan, and the cleaning attachment is a vacuuming nozzle.

3. The apparatus of claim 1 wherein the handle is configured to be removably attached to the base by being hooked onto the bracket and then pivoted relative to the bracket into an installed position and secured in the installed position.

4. A cleaning apparatus comprising:

a base;

a bracket attached to the base;

wheels rotatably attached to the base for wheeling the base across a floor;

a cleaning attachment configured to be attached to the base and moved against the floor to clean the floor as the base is wheeled across the floor; and a handle for manually pushing the base by the handle to wheel the base across the floor, and configured to be removably attached to the base by being hooked onto the bracket and then pivoted relative to the bracket into an installed position and secured in the installed position;

wherein the handle, in its installed position, is fixedly attached to the bracket, and the bracket is pivotably attached to the base to enable the handle to pivot relative to the base.

5. The apparatus of claim 4 further comprising an outlet port through which the base exhausts dirt-laden air, the outlet port being fixed to the bracket.

6. A cleaning apparatus comprising:

a base;

a bracket attached to the base;

wheels rotatably attached to the base for wheeling the base across a floor;

a cleaning attachment configured to be attached to the base and moved against the floor to clean the floor as the base is wheeled across the floor; and a handle for manually pushing the base by the handle to wheel the base across the floor, and configured to be removably attached to the base by being hooked onto the bracket and then pivoted relative to the bracket into an installed position and secured in the installed position;

wherein the base is configured to operatively sense whether the handle is attached to the base and control an operating condition of the apparatus based on whether the handle is attached.

7. A cleaning apparatus comprising:

a base;

a bracket attached to the base;

wheels rotatably attached to the base for wheeling the base across a floor;

a cleaning attachment configured to be attached to the base and moved against the floor to clean the floor as the base is wheeled across the floor;

a handle for manually pushing the base by the handle to wheel the base across the floor, and configured to be removably attached to the base by being hooked onto the bracket and then pivoted relative to the bracket into an installed position and secured in the installed position; and a differently-configured handle configured to be removably attached to the base by being hooked onto the bracket and then pivoted relative to the bracket into an installed position.

8. The apparatus of claim 7 wherein the base is configured to sense which of the handles is attached and control an operating condition of the base based on which of the handles is attached.

* * * * *